US007752946B2

(12) United States Patent
Wang

(10) Patent No.: US 7,752,946 B2
(45) Date of Patent: Jul. 13, 2010

(54) SOCKET FOR WRENCHES

(76) Inventor: Shyh-Ming Wang, No. 37-2, Ching-Dau 1st Street, Taichung (TW) 404

( * ) Notice: Subject to any disclaimer, the term of this patent is extended or adjusted under 35 U.S.C. 154(b) by 0 days.

(21) Appl. No.: 12/368,296

(22) Filed: Feb. 9, 2009

(65) Prior Publication Data

US 2009/0151520 A1 Jun. 18, 2009

Related U.S. Application Data

(63) Continuation-in-part of application No. 11/396,842, filed on Apr. 4, 2006, now abandoned.

(51) Int. Cl.
*B25B 13/02* (2006.01)
*B25B 13/00* (2006.01)

(52) U.S. Cl. ..... 81/125; 81/124.1; 81/124.6

(58) Field of Classification Search ..... 81/125, 81/124.1, 124.6, 124.7, 185
See application file for complete search history.

(56) References Cited

U.S. PATENT DOCUMENTS 2,387,339 A * 10/1945 Meyer ..... 279/61
2,468,867 A * 5/1949 Collins ..... 81/442
3,349,655 A * 10/1967 Locke ..... 81/185
3,861,693 A * 1/1975 Huber ..... 279/61
3,869,945 A * 3/1975 Zerver ..... 81/125
4,305,597 A * 12/1981 McCarty ..... 279/22
4,416,173 A * 11/1983 Rebish ..... 81/185
4,608,887 A * 9/1986 Colvin ..... 81/128
4,724,730 A * 2/1988 Mader et al. ..... 81/53.2
5,012,704 A * 5/1991 Wing ..... 81/59.1
5,048,378 A * 9/1991 Nikolas ..... 81/124.2
5,129,291 A * 7/1992 Poniatowski ..... 81/446
5,148,727 A * 9/1992 Williamson ..... 81/121.1
5,234,223 A * 8/1993 Sakamaki ..... 279/61
5,328,308 A * 7/1994 Ducker et al. ..... 408/226
5,348,318 A * 9/1994 Steadings et al. ..... 279/62
5,411,275 A * 5/1995 Huff et al. ..... 279/62
5,511,451 A * 4/1996 Steen et al. ..... 81/55
5,544,555 A * 8/1996 Corley et al. ..... 81/125
5,577,743 A * 11/1996 Kanaan et al. ..... 279/72
5,687,623 A * 11/1997 Hsieh ..... 81/60
5,697,268 A * 12/1997 Makovsky et al. ..... 81/125
5,782,148 A * 7/1998 Kerkhoven ..... 81/124.6
5,927,160 A * 7/1999 Hsieh ..... 81/125
5,960,681 A * 10/1999 Anderson et al. ..... 81/125
6,045,141 A * 4/2000 Miles et al. ..... 279/62
6,073,520 A * 6/2000 Bueno et al. ..... 81/53.2
6,170,363 B1 * 1/2001 Hu ..... 81/125
6,193,242 B1 * 2/2001 Robison ..... 279/137

(Continued)

*Primary Examiner*—Joseph J Hail, III
*Assistant Examiner*—Alvin J Grant

(57) ABSTRACT

This present invention discloses a socket for wrenches, which comprises a main body having a proximal section, a distal section, and a central axis extending from proximal section to distal section. The main body has recess at inside on the proximal section with punctures on the recessed periphery and each puncture has a moving part mounted therethrough. A sleeve is in slide-fitting communication with the main body, which has an inner wall provided a plurality of push fronts thereon, each push front surface rises gradually by a plurality of continuous steps from one end to the other. When the sleeve is rotated of axially moved with respect to the main body, the gradual rising steps of the push fronts are pushing the moving parts toward the central axis to match with varieties of scales of work pieces.

11 Claims, 4 Drawing Sheets

U.S. PATENT DOCUMENTS 6,206,160 B1 * 3/2001 Chen ..... 192/43.2
6,390,739 B1 * 5/2002 O'Banion ..... 408/239 R
6,540,237 B1 * 4/2003 Temple-Wilson ..... 279/62
6,637,755 B2 * 10/2003 Chen et al. ..... 279/22
6,715,384 B1 * 4/2004 Kozak ..... 81/124.2
6,848,691 B2 * 2/2005 Yang et al. ..... 279/62
6,880,432 B2 * 4/2005 Hsieh ..... 81/62
6,966,562 B1 * 11/2005 Wienhold ..... 279/75
7,104,163 B2 * 9/2006 Hu ..... 81/124.3
7,159,491 B1 * 1/2007 Chaconas et al. ..... 81/58.1
7,160,065 B2 * 1/2007 Huggins et al. ..... 408/240
7,185,567 B2 * 3/2007 Ide ..... 81/176.15
7,195,247 B2 * 3/2007 Shu ..... 279/75
7,249,540 B1 * 7/2007 Hacker et al. ..... 81/124.5
7,331,584 B2 * 2/2008 Zhang et al. ..... 279/60
7,437,975 B1 * 10/2008 De Anfrasio ..... 81/121.1
2004/0007098 A1 * 1/2004 Hsieh ..... 81/60
2004/0016900 A1 * 1/2004 Kouda ..... 251/149.9
2004/0226414 A1 * 11/2004 Hsieh ..... 81/60
2005/0160886 A1 * 7/2005 Eggert et al. ..... 81/467
2007/0186729 A1 * 8/2007 Baker ..... 81/57.39

* cited by examiner

SOCKET FOR WRENCHES

RELATED APPLICATION

This application is a Continuation-in-Part of U.S. application Ser. No. 11/396,842, entitled "SOCKET FOR A WRENCH", naming Shyh-Ming Wang as inventor, and filed on Apr. 4, 2006 now abandoned.

FIELD OF THE INVENTION

The present invention is relates to a socket of wrenches, and more particularly to a socket with a simplified structure that can effectively and exactly match with varieties of scales of work pieces by steps.

BACKGROUND OF THE INVENTION

As what had been acknowledged, the current patent of common size and structure adjustable wrench sleeves such as U.S. Pat. No. 6,374,710 is using the retractable effect of a plurality of pillar posts mounted inside the sleeve to match with varieties of specifications of work pieces. The structure is more than complicated, quite a number of elements (such as sleeve 1, pillar post 3, retaining rod 4 and retraction spring 5) are required and necessary to be accommodated into sleeve 1, which needs higher cost in manufacturing and is presumed inconvenient to use because aligning is required when using it.

U.S. Pat. Nos. 1,471,451 and 3,698,267 are also about couplings of varieties of specifications, which are similar concept in structure design to the above-mentioned U.S. Pat. No. 6,374,710 and bear the same shortages in use. U.S. Pat. No. 2,387,339 and No. 4,608,887 are sockets with complicate threaded structure and clamp the workpiece by radial and axial movement. And U.S. Pat. No. 5,927,160 has no the function for matching with varieties of scales of work pieces.

SUMMARY OF THE INVENTION

This invention comprises a main body that has a proximal section and a distal section; the central axis of the proximal section extends to the distal section. The main body has recess at inside on the proximal section with punctures on the recessed periphery; each puncture has a moving part mounted therethrough. A sleeve is in slide-fitting communication with the main body; inner wall of the sleeve has a plurality of push fronts, each push front surface rises gradually from one end to the other. When the sleeve is rotating or axially moving with respect to the main body, the gradual rising push fronts are pushing the moving parts toward the central axis to match with varieties of scales of work pieces by steps.

DETAILED DESCRIPTION OF THE PREFERRED EMBODIMENT

Figure 1:
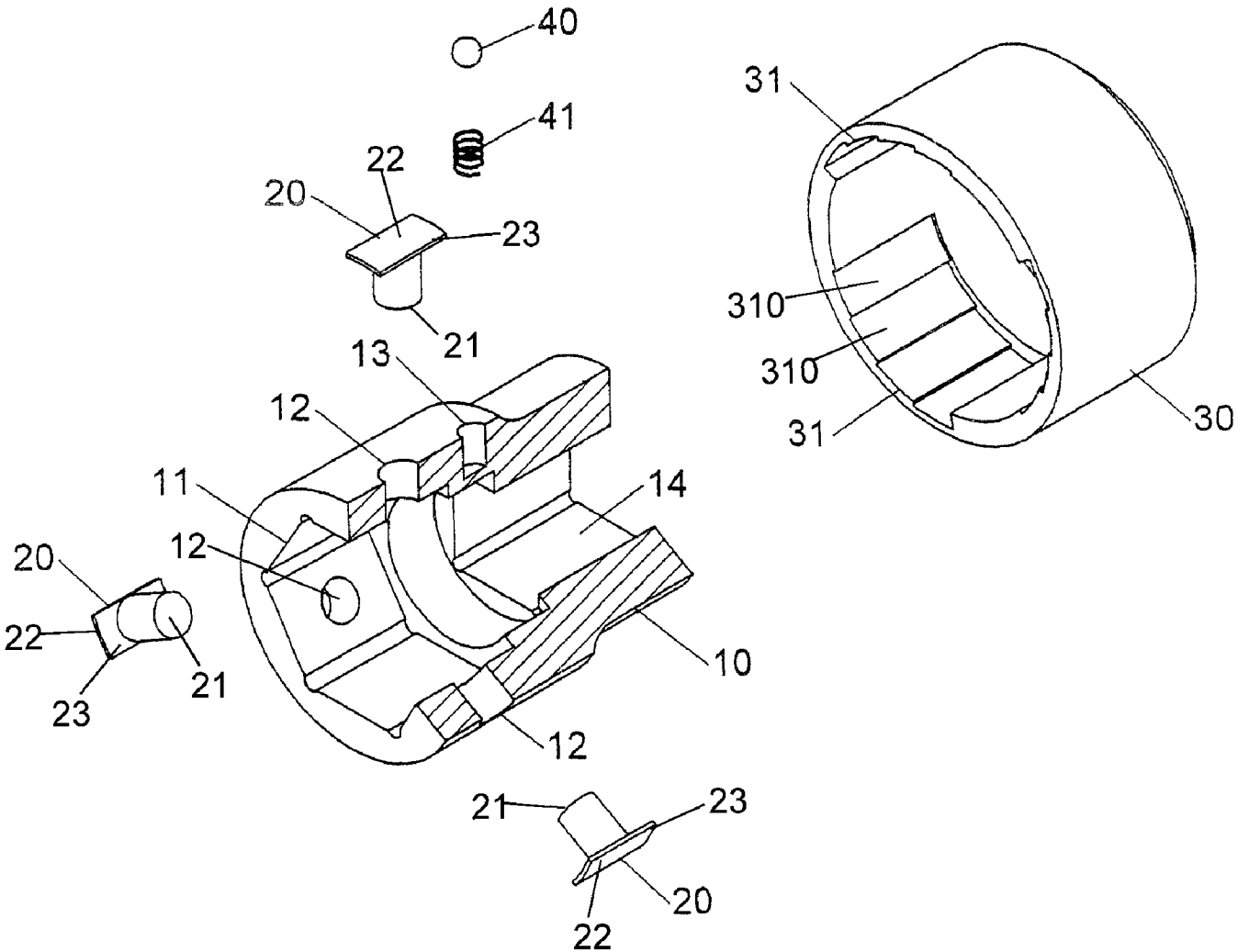
FIG. 1 is an exploded perspective of the present invention.
Figure 2:
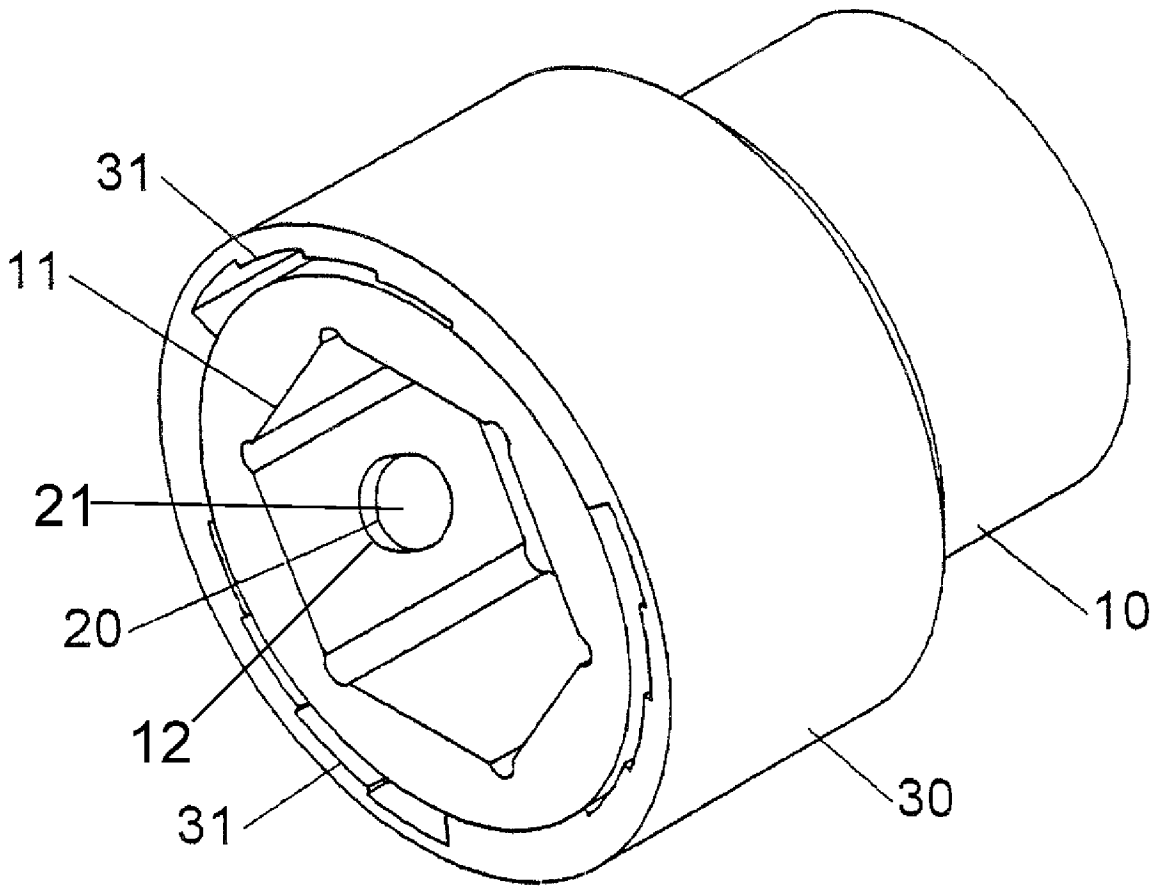
FIG. 2 is an assembly appearance of FIG. 1.
Figure 3:
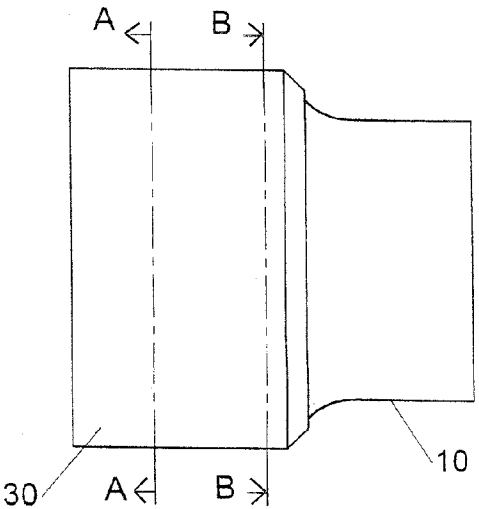
FIG. 3 is a side view of FIG. 2.

As shown in FIGS. 1 to 7, this invention comprises a main body 10 that has a proximal section, a distal section provided with a square receiving hole 14 for a driving spanner to connect to, and a central axis extending from the proximal section extends to the distal section. The main body 10 has a recess 11 on the proximal section provided three radially extending punctures 12 thereon connecting with the recess 11; each puncture 12 has a moving part 20 only radial-direction movably (i.e. radially movably) mounted therethrough, the moving part 20 has a primary end formed a plane surface 21 and a secondary end formed a first arc surface 22. A sleeve 30 has an inner wall and is in slide-fitting communication with the outside of the main body 10, which has its central axis parallel with the central axis of the main body 10. The inner wall of the sleeve 30 has three push fronts 31 each corresponding to one moving part 20, each push front 31 contacts with the first arc surface 22 of the secondary end of the moving part 20, the surface of each push front 31 rises gradually by a plurality of continuous steps from one end to the other. When the sleeve 30 is moved (rotated or axially moved) with respect to the main body 10, the gradual rising push fronts 31 are pushing the moving parts 20 toward the central axis (comparing with FIGS. 4 and 5), and then a work piece with smaller scale can be fitted into.

Figure 6:
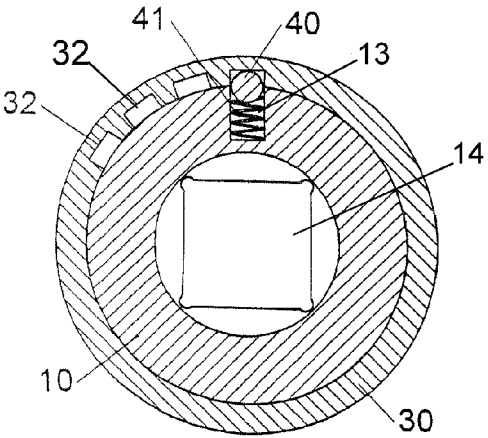
FIG. 6 is the cross-sectional view, taken along line B-B in FIG. 3.

As shown in FIGS. 1 and 6, a ball groove 13 is implemented on the periphery of the main body 10 with a spring 41 and a sphere 40 mounted thereinto. There is a plurality of cavities 32 on the inner wall of the sleeve 30, which are implemented to have the sphere 40 to be positioned in to. The push front 31 on the inner wall of the sleeve 30 is shaped as continuous steps 310, and the distance of the center of two adjacent cavities 32 is equal to the distance of the center of two adjacent steps 310 of each push front 31, each step 310 formed by a second arc surface with a radius being equal to the radius of the first arc surface 22 of the moving part 20, so that each step 310 can exactly and effectively touch with the first arc surface 22 of the secondary end of the moving part 20.

Figure 4:
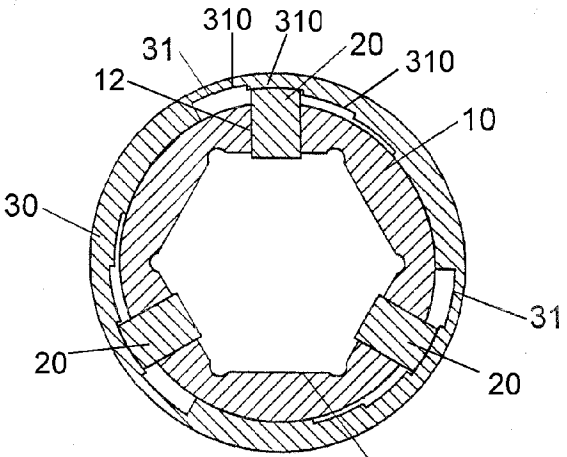
FIG. 4 is the cross-sectional view, taken along line A-A in FIG. 3.

As shown in FIG. 4, the outline of the recess 11 is in the shape of polygon in the view of cross-section which is vertical with respect to the central axis. And the embodiment in FIG. 4, the polygon is a hexagon.

As shown in FIG. 1, the secondary end of the moving part 20 connects with a rigid plate 23 and the first arc surface 22 formed thereon, so that the moving part 22 formed to be a thin body, and remain the first arc surface 22 having a big dimension so as to exactly and effectively touch with the step 310.

Figure 5:
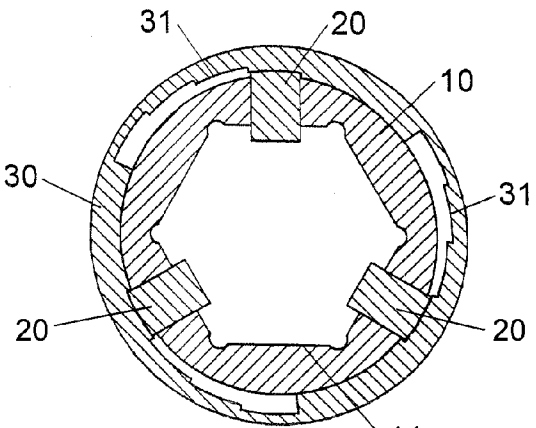
FIG. 5 is the motion diagram of moving part with respect to FIG. 4.
Figure 7:
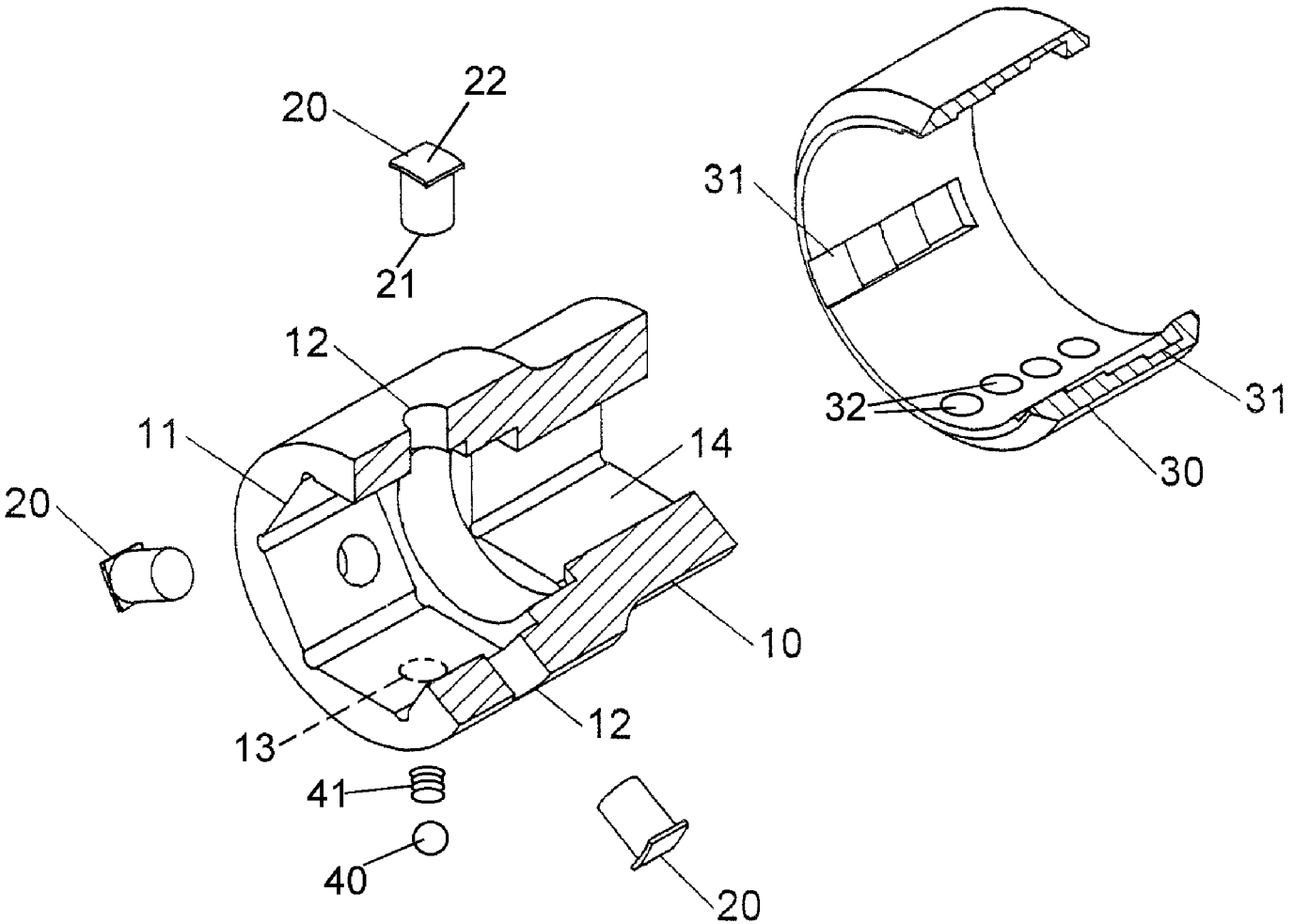
FIG. 7 is another distributed embodiment of the push front of the present invention.

According to mentioned previously, the sleeve 30 of the present invention can be rotated or axially moved with respect to the main body 10, the gradual rising push fronts 31 will push the moving parts 20 toward the central axis of the main body 10, and then a workpiece with smaller scale can be fitted into. With respect to rotate mode, as shown in FIGS. 1, 4 and 5, the steps 310 of each push front 31 are annularly distributed along the second central axis, the gradual rising push fronts 31 can push the moving parts 20 toward the central axis when the sleeve 30 is rotated with respect to the main body 10. With respect to axially move mode, as shown in FIG. 7, the steps 310 of each push front 31 are axially distributed along the second central axis, the gradual rising steps 310 of the push fronts 31 can push the moving parts 20 toward the central axis when the sleeve 30 is axially moved with respect to the main body 10.

While we have shown and described the embodiment in accordance with the present invention, it should be clear to those skilled in the art that further embodiments may be made without departing from the scope of the present invention.

What is claimed is:

1. A socket for wrenches comprises:

a main body having a proximal section for engaging nuts and a distal section for receiving a driving element, and a central axis extending from the proximal section to the distal section, the distal section having a square receiving hole, the proximal section having a recess connecting with the square receiving hole and three radially extending punctures connecting with the recess, the outline of the recess being in the shape of hexagon in the view of a cross-section which is vertical with respect to the central axis, each puncture having a moving part radially movably mounted therethrough, the moving part having a primary end forming a plane surface and a secondary end forming a first arc surface; a ball groove being implemented on the periphery of the main body with a spring and a sphere mounted therein; and a sleeve having an inner wall and being in slide-fitting communication with the outside of the main body, and having a second central axis parallel with the central axis of the main body, the inner wall of the sleeve being provided with three push fronts thereon each corresponding to one moving part, wherein the push front on the inner wall of the sleeve being shaped as continuous steps, the steps of each push front rising gradually from one end to the other, and the inner wall of the sleeve being provided with a plurality cavities thereon, the cavities implemented to have the sphere positionable thereinto, and the distance of the center of two adjacent cavities being equal to the distance of the center of two adjacent steps of each push front;

so that the steps of the push fronts are adapted to push the moving parts when the sleeve is moved with respect to the main body.

2. The socket as claimed in claim 1, wherein each step formed by a second arc surface with a radius being equal to the radius of the first arc surface of the moving part.

3. The socket as claimed in claim 1, wherein the secondary end of the moving part being connected with a rigid plate and the first arc surface formed thereon.

4. The socket as claimed in claim 1, wherein the steps of each push front are annularly distributed along the second central axis, the gradual rising push fronts being configured to push the moving parts toward the central axis when the sleeve is rotated with respect to the main body.

5. The socket as claimed in claim 1, wherein the steps of each push front are axially distributed along the second central axis, the gradual rising push fronts being configured to push the moving parts toward the central axis when the sleeve is axially moved with respect to the main body.

6. A socket for wrenches comprises:

a main body having a proximal section for engaging nuts and a distal section for receiving a driving element, and a central axis extending from the proximal section to the distal section, the distal section having a square receiving hole, the proximal section having a recess connecting with the square receiving hole and three radially extending punctures connecting with the recess, each puncture having a moving part radially movably mounted therethrough, the moving part having a primary end formed a plane surface and a secondary end formed a first arc surface; a ball groove being implemented on the periphery of the main body with a spring and a sphere mounted therein; and a sleeve having an inner wall and being in slide-fitting communication with the outside of the main body, and having a second central axis parallel with the central axis of the main body, the inner wall of the sleeve being provided with three push fronts thereon each corresponding to one moving part, wherein the push front on the inner wall of the sleeve being shaped as continuous steps, the steps of each push front rising gradually from one end to the other, and the inner wall of the sleeve being provided with a plurality cavities thereon, the cavities being implemented to have the sphere positionable thereinto, and the distance of the center of two adjacent cavities being equal to the distance of the center of two adjacent steps of each push front;

so that the steps of the push fronts are adapted to push the moving parts when the sleeve is moved with respect to the main body.

7. The socket as claimed in claim 6, wherein each step formed by a second arc surface with a radius being equal to the radius of the first arc surface of the moving part.

8. The socket as claimed in claim 6, wherein the secondary end of the moving part being connected with a rigid plate and the first arc surface formed thereon.

9. The socket as claimed in claim 6, wherein the steps of each push front are annularly distributed along the second central axis, the steps of the push fronts being configured to push the moving parts toward the central axis when the sleeve is rotated with respect to the main body.

10. The socket as claimed in claim 6, wherein the steps of each push front are axially distributed along the second central axis, the steps of the push fronts being configured to push the moving parts toward the central axis when the sleeve is axially moved with respect to the main body.

11. The socket as claimed in claim 6, wherein the outline of the recess is in the shape of hexagon in the view of a cross-section which is vertical with respect to the central axis.

* * * * *